United States Patent [19]

Tamba et al.

[11] Patent Number: 4,590,890

[45] Date of Patent: May 27, 1986

[54] FAN HOUSING FOR ENGINE

[75] Inventors: Shinichi Tamba; Noboru Fukui, both of Kakogawa, Japan

[73] Assignee: Kawasaki Jukogyo Kabushiki Kaisha, Hyogo, Japan

[21] Appl. No.: 683,506

[22] Filed: Dec. 19, 1984

[30] Foreign Application Priority Data

Dec. 20, 1983 [JP] Japan ..... 58-241707

[51] Int. Cl.[4] ..... F01P 1/02

[52] U.S. Cl. ..... 123/41.7; 56/12.8; 123/195 C

[58] Field of Search ..... 123/195 C, 198 E, 41.7; 56/16.7, 12.8, 16.8, 17.1, 17.2, 255, 229, 320.1, 320.2; 220/82 R, 85 S

[56] References Cited

U.S. PATENT DOCUMENTS

| | | | |
|---|---|---|---|
| 2,676,559 | 4/1954 | Davies | 123/198 E |
| 4,166,431 | 9/1979 | Pickering | 220/82 R |
| 4,510,739 | 4/1985 | Dluhosch | 123/195 C |

*Primary Examiner*—William A. Cuchlinski, Jr.

[57] ABSTRACT

A housing for an engine cooling fan which is mounted on the top of a vertical engine output shaft with the inner space of a double wall serving as a fuel tank. The fan housing comprises a weatherproof synthetic resin outer wall forming the upper half of the fan housing and a transparent synthetic resin inner wall forming the lower half, both being hermetically integrated into one piece.

2 Claims, 2 Drawing Figures

FAN HOUSING FOR ENGINE

BACKGROUND OF THE INVENTION

This invention relates to a housing for an engine cooling fan mounted on the top of a vertical engine output shaft.

Aiming to give a compact shape to the whole engine and prevent fuel vapor lock by means of cooling, the prior art is well known where a housing for engine cooling fan mounted on an engine output shaft is made up of a double wall construction around the cooling air intake, with the double wall serving as a fuel tank.

With vertical engines, since the engine cooling fan is mounted on the top of the engine output shaft, the outer surface of the fan housing is required of weatherability. And when the fan housing is constructed of a double wall so that its internal space is utilized for the fuel tank, the complex shaped fuel tank makes it difficult to install a float-type oil gauge or gauge glass, thereby producing a drawback of no practical way in detecting the residual amount of fuel.

SUMMARY OF THE INVENTION

To solve aforesaid drawback of the prior art for vertical engine cooling fan housings whose double wall is utilized to store fuel gave rise to the present invention.

Thus it can be said that the purpose and object of this invention is to provide a cooling fan housing which is simple in configuration, resistant to weather, easy to visualize the residual amount of fuel in the fuel tank and simple to manufacture.

To achieve aforesaid purpose, a fan housing according to this invention is characterized by comprising a weatherproof synthetic resin outer wall forming the upper half of the fan housing and a transparent synthetic resin inner wall forming the lower half, both being hermetically connected into one piece.

Thus, the configuration according to the invention provides the upper part of the fan housing exposed to the elements with adequate weatherproof and the lower part with visualization of the residual fuel in the complex-shaped fuel tank through the transparent inner wall.

DETAIL DESCRIPTION OF THE PREFERRED EMBODIMENT

Figure 1:
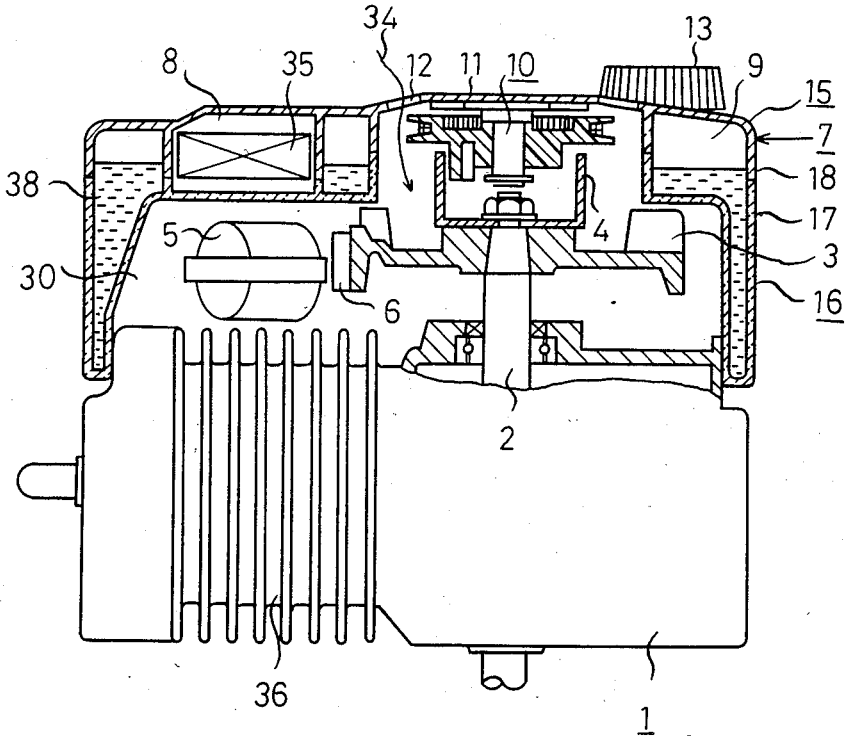
FIG. 1 is a side sectional view showing an embodiment of a fan housing according to the invention along with an engine body and a cooling fan.

Referring now in detail to the illustrative embodiment depicted in FIG. 1, there is shown a side sectional view of a fan housing of a general-purpose vertical engine according to the invention with an engine body and a cooling fan.

Numeral 1 is an engine body. Numeral 2 is a crankshaft, on which an engine cooling fan 3 and a driven pulley 4 are secured where the crankshaft projects above the engine body 1. Numeral 5 is an ignition coil 5, which is placed opposed to a permanent magnet 6 arranged on the periphery of the engine cooling fan 3.

Numeral 7 is a synthetic resin fan housing, which covers the engine cooling fan 3 along with said driven pulley 4 and the ignition coil 5. The fan housing is a double wall construction, a hollow part of which forms an air cleaner chamber 8 and the hollow rest constitutes a fuel tank. On the central inner face of the fan housing 7 is installed a recoil starter 10 driving said driven pulley 4, and further in said central portion are opened a number of engine cooling air intake ports, which are enclosed by said fuel tank 9. Numeral 13 is a tank cap.

Figure 2:
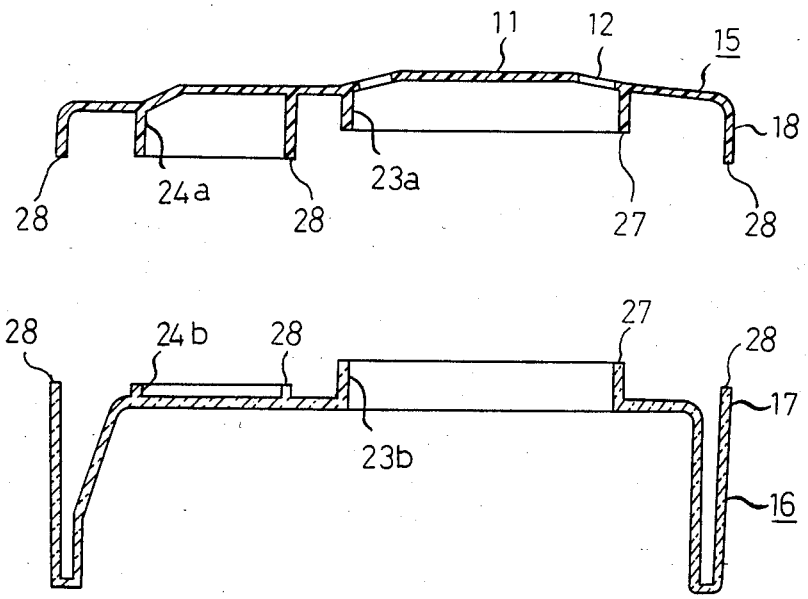
FIG. 2 is an exploded side sectional view of the fan housing in FIG. 1.

The fan housing, as shown in FIG. 2, is divided into a housing outer wall 15 with an oil port (not shown) on the top and a housing inner wall 16, whose lower periphery 17 is doubled up at the outside to abutt against the lower periphery 18 of said outer wall 15, and is hermetically integrated into a double wall housing. Said outer wall 15 is made of synthetic resin mixed with carbon or of colored weatherproof material, while the inner wall 16 is made of transparent resin.

Such being the construction of a fan housing according to the invention, the outer surface subject to the elements can obtain adequate weatherability as well as the residual amount of fuel in the fuel tank can be easily visualized through the tank lower periphery of the transparent inner housing wall. The transparency over the whole circumference of the lower housing provides a good sight of residual fuel through the periphery, in any tilted attitude of an engine.

What is claimed is:

1. A combined fan housing and fuel tank assembly for attachment to the top of a vertical engine and above the output shaft thereof, comprising:

(a) an upper shell constructed of a pigmented weather resistant synthetic plastic resin and provided with a depending skirt at its outer periphery forming an outer wall and a depending inner wall spaced inwardly from said outer wall forming, together with said outer wall, part of a fuel tank, and (b) a lower shell constructed of transparent synthetic resin and provided with like outer and inner walls in engagement with and hermetically sealed to corresponding walls of said upper shell to form said fuel tank.

2. An assembly according to claim 1 further comprising an air cleaning chamber depending from said housing and defined by further walls spaced inwardly from said depending inner wall of said upper shell.

* * * * *